US009017178B2

(12) United States Patent
Jackson

(10) Patent No.: US 9,017,178 B2
(45) Date of Patent: Apr. 28, 2015

(54) CANOPY OR LIVING MAT FOR HIDING SUPPORT FEATURES ON A RIDE OR DISPLAY PLATFORM

(71) Applicant: Disney Enterprises, Inc., Burbank, CA (US)

(72) Inventor: Philip John Jackson, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 80 days.

(21) Appl. No.: 14/034,715

(22) Filed: Sep. 24, 2013

(65) Prior Publication Data

US 2015/0087431 A1 Mar. 26, 2015

(51) Int. Cl.
*A63J 1/02* (2006.01)
*A63G 21/02* (2006.01)

(52) U.S. Cl.
CPC ..... *A63J 1/02* (2013.01)

(58) Field of Classification Search
CPC ..... A63G 1/00; A63G 21/00; A63G 21/02; A63G 21/04; A63G 21/08; A63G 31/00; A63G 31/16
USPC ..... 472/36, 40, 43, 59, 60, 130, 75, 81
See application file for complete search history.

(56) References Cited

U.S. PATENT DOCUMENTS

| | | | | |
|---|---|---|---|---|
| 1,555,028 | A * | 9/1925 | Roth | 104/60 |
| 6,254,489 | B1 * | 7/2001 | Drobnis et al. | 472/65 |
| 7,354,351 | B2 * | 4/2008 | Edwards | 472/43 |
| 7,905,790 | B2 * | 3/2011 | Schnuckle | 472/43 |
| 8,313,389 | B2 * | 11/2012 | Crawford et al. | 472/41 |

* cited by examiner

*Primary Examiner* — Kien Nguyen
(74) *Attorney, Agent, or Firm* — Marsh Fischmann & Breyfogle LLP; Kent A. Lembke

(57) ABSTRACT

An assembly adapted for visually disguising drive or support features of an amusement park ride or a display system using a drive to move a show element about a space. The assembly includes a platform and a drive mechanism for selectively moving a support member. The assembly also includes an object supported upon an end of the support member spaced apart from the drive mechanism, and the support member extends through a slot in the platform. The assembly also includes a canopy positioned between the supported object and a surface of the platform facing the supported object. The canopy blocks an observer from seeing the slot in the platform. The canopy includes a plurality of camouflaging elements positioned between the slot in the platform and the supported object, and the camouflaging elements are arranged in two or more layers.

20 Claims, 5 Drawing Sheets

CANOPY OR LIVING MAT FOR HIDING SUPPORT FEATURES ON A RIDE OR DISPLAY PLATFORM

BACKGROUND

1. Field of the Description

The present description relates, in general, to systems for use in disguising or even hiding support features for a ride vehicle or for a show/display element, and, more particularly, to an assembly that is useful for camouflaging the existence of a slot in a floor or platform through which a rod (or other support element) extends between a drive system (e.g., a bogie traveling on a track) and a supported vehicle or show element.

2. Relevant Background

There are numerous applications where it is desirable to disguise or hide drive mechanisms and techniques used to move an object. For example, amusement park rides are often designed in a thematic manner where ride vehicles are designed to simulate a particular form of transportation, but this illusion is hampered when passengers can readily see an underlying track and support mechanisms. In other cases, a show or display may be presented that includes a show element, such as an animatronic or robotic character or creature, which is designed to appear to be moving under their own power. In actuality, though, the show element may be moved and positioned in a manner similar to the vehicle in the amusement park ride (e.g., the character/creature is moved along a track by a drive mechanism riding on the track).

Some rides and show/display sets attempt to hide the presence of the drive system by providing a platform or floor between much of the drive system and the object that is being moved by the drive system. In the ride example, a passenger vehicle may be supported on one or more poles extending from a bogie riding on a track. A slot is provided in a platform positioned between the bogie/track and the vehicle through which the poles pass. However, the existence of the slot in the platform can give away how the vehicle is supported and moved along the ride path because the passengers (or observing crowds) may have a point of view or line of sight that allows them to see the floor/platform and can quickly determine the true mode of movement.

Attempts to hide this slot or gap in the floor or platform have not been particularly effective. Some ride or show designs will place a pair of brushes or rubber or metal plates within the gap, but these brushes are typically only useful for limiting debris from falling through the gap because a viewer can see the edges of the gap and also the brushes themselves, which gives away the gap in the platform and a path that a vehicle or show element will follow. In other cases, the space below the vehicle or show element is kept dark or lowly illuminated compared with other nearby spaces, but this limits the design of the show or ride and is not useful in many settings such as outdoor venues where natural lighting may be quite bright. Other solutions involve limiting the line of sight to the slot such as by arrangement of passenger seats to urge passengers to look away from the platform, but this is only of limited value as observers outside the vehicles (such as passengers in a line to board the vehicles) can still see the slot in the platform or the passengers themselves may still look around and under the vehicle.

Hence, there remains a need for improved ways to disguise or even hide the existence of support and/or drive features of amusement park rides and of track-based show elements. Preferably, the devices used would reduce visible signs of slots in a platform and of supporting rods extending out from the platform. Further, it may be desirable for the devices to be presented in plain sight of all observers or at least those in or viewing the supported object (e.g., passenger vehicle or robotic show/display element), and, in such cases, the devices preferably would be useful in a scenic environment (be themed to the set of the show or ride) in a natural or organic manner.

SUMMARY

The present description teaches a system or assembly that is particularly suited to hiding a slot or gap in a ride or show/display platform. The slot or gap is used to provide a passageway for one or more support elements (e.g., a rigid pole or rod) that extend between a drive mechanism (e.g., a bogie riding on a track) and a supported object (e.g., a passenger vehicle or show/display element such as a robotic character). The assembly includes a canopy or living mat made up of numerous camouflage elements positioned adjacent (e.g., over, below, or to the side of) the slot/gap in the platform, with the camouflage elements mounted onto structural supports that may be attached to a surface of the platform on either side of the slot/gap in the platform.

The canopy or living mat may be thought of as providing a plurality of camouflage elements that have bodies and protrusions (e.g., fingers, branches, tendrils, blades, and the like) often with organic shapes. The bodies and/or protrusions may be rigid and when placed in the path of a support rod (over or adjacent the slot) be mounted for at least some rotation on the structural support. The bodies and/or protrusions may also have an adequate amount of flexibility to be bent or deformed or otherwise moved out of the path of the pole/rod via contact with the outer surfaces of the support pole/rod. The camouflage elements may then spring back to their original form and/or position relative to the slot or gap in the platform.

The flexibility of the elements may be altered or selected through design (e.g., size and shape of the protrusions or bodies and whether these are hollow or solid) and/or by material characteristics used to form the elements, and the flexibility and body/protrusion design parameters will affect how each moves relative to the pole/rod and relative to neighboring ones of the camouflage elements (e.g., bounce back, flex, rotation, and so on). In some cases, the flexibility (or other movement) of each camouflage element can be adjusted by adjustments performed as part of mounting the elements onto a structural support, with variable flexibility of the elements desirably enhancing the variance in movement of the elements and how the support rod (and, in some cases, the supported object) interacts with the camouflage elements. For example, each of the elements may have a body with a socket or receptacle for receiving a mounting post/rod (e.g., an end of the body may take the form of a hollow tube), and the length of the mounting post inserted into the body can be used to set or define the amount of body flex (e.g., flex is reduced to a predefined minimum amount by fully inserting the mounting post or increased to a maximum amount by minimally inserting the mounting post).

In the space over or adjacent to the slot, the canopy is made up of two, three, four, or more layers or tiers of the camouflage elements. The depth of the canopy at this location over the slot is defined by how many of the camouflage elements are used (e.g., to provide a multi-tiered or multi-layered live mat) and how spacing is provided (if any) between adjacent layers/levels. In this manner, one or more layers may be pushed aside by the support rod/pole, which could potentially allow viewing of the slot in the platform were it not for the additional one, two, or more layers of camouflage elements that have not been moved by the support rod (or have been moved differently such as into the line of sight cleared by movement of another of the camouflage elements). The overlapping camouflage elements extend into and across the slot above the ride/show track.

The presence of the slot in the platform and other support features (such as the support pole/rod) can further be hidden or disguised through a variety of other techniques such as by providing a flow of fog or smoke over the platform near the slot, providing a volume of water over the platform below or among the camouflage elements, and/or using lights and/or lasers (e.g., on the fog or smoke or on the canopy or other assembly components) to distract the viewers to a line of sight away from the platform slot.

More particularly, an assembly is provided that is adapted for visually disguising drive or support features of an amusement park ride or a display system using a drive to move a show element about a space. The assembly includes a platform (e.g., a floor, a side wall, a ceiling, or the like) and a drive mechanism for selectively moving a support member. The assembly also includes an object supported upon an end of the support member spaced apart from the drive mechanism, and the support member extends through a slot in the platform. For example, a passenger vehicle or a robotic figure may be supported upon one or more poles, rods, or shafts that extend between vehicle or figure and a tracked bogie via a slot or gap in the platform. The assembly also includes a canopy positioned between the supported object and a surface of the platform facing the supported object.

The canopy acts to block an observer (e.g., a passenger in the supported vehicle or a member of an audience watching a show/display) from seeing the slot in the platform and all or portions of the support member. To this end, the canopy includes a plurality of camouflaging elements positioned between the slot in the platform and the supported object. In some embodiments of the assembly, the camouflaging elements are arranged in two or more layers adjacent to the slot. In these embodiments, at least a portion of the camouflaging elements in adjacent pairs of the layers at least partially overlap (e.g., when viewed from the supported object). Further, in such embodiments, the support member contacts and moves a number of the camouflaging elements when the drive mechanism operates to move the support member through the canopy.

In some implementations of the assembly, a subset of the camouflaging elements is rotatably mounted on structural supports, whereby each one the subset of the camouflaging elements independently rotates in response to being contacted by the support member or the supported object. In the same or other implementations, a number of the camouflaging elements include a flexible and resilient shaft supporting an upper body. Then, the camouflaging elements may further include a plurality of flexible and resilient arms or protruding members extending outward from a central portion of the upper body. Also, the shafts can be attached to a structural member via a connecting rod such that an end of the connecting rod is inserted a depth within a receptacle in an end of the shaft, whereby flexibility of the shaft is controlled by the depth.

In some cases, a first set of the camouflaging elements is supported by a first set of structural supports attached to the surface of the platform on a first side of the slot in the platform, and a second set of the camouflaging elements is supported by a second set of structural supports attached to the surface of the platform on a second side of the slot in the platform. Then, a gap is provided between the first and second set of the structural supports between the slot and the object, whereby the support member is movable through the canopy free of contact with the structural supports.

DETAILED DESCRIPTION

The present description is directed toward a canopy or "living mat" that is useful for blocking or hiding support features of an amusement park ride or a show/display assembly. For example, an amusement park ride may include a passenger vehicle supported from below on poles/rods attached to a bogie traveling along a track. The poles/rods may extend through a slot or gap in a ride platform that is used to hide drive equipment from view by the ride passengers. However, the poles/rods and the slot they extend through in the platform are often visible, which can destroy the passenger's belief in the motive force or devices used to move the passenger vehicle (e.g., not believable the vehicle is floating or rolling if can see the ride track/slot and support poles). Similarly, show or display elements such as an animatronic creature may be moved about a set or stage with the vehicle and track used to move the creature behind or below a platform/floor/wall, but a slot in the platform surface and supporting features often give away the technique used to move or position the creature. With this in mind, the inventor created a canopy or living mat that can be placed between the object being supported and moved through a space (e.g., vehicle, show element, animatronic, and the like) and an exposed (e.g., upper or outer) surface of the platform (which is used to hide the presence of a track and track-based drive vehicle).

Figure 1:
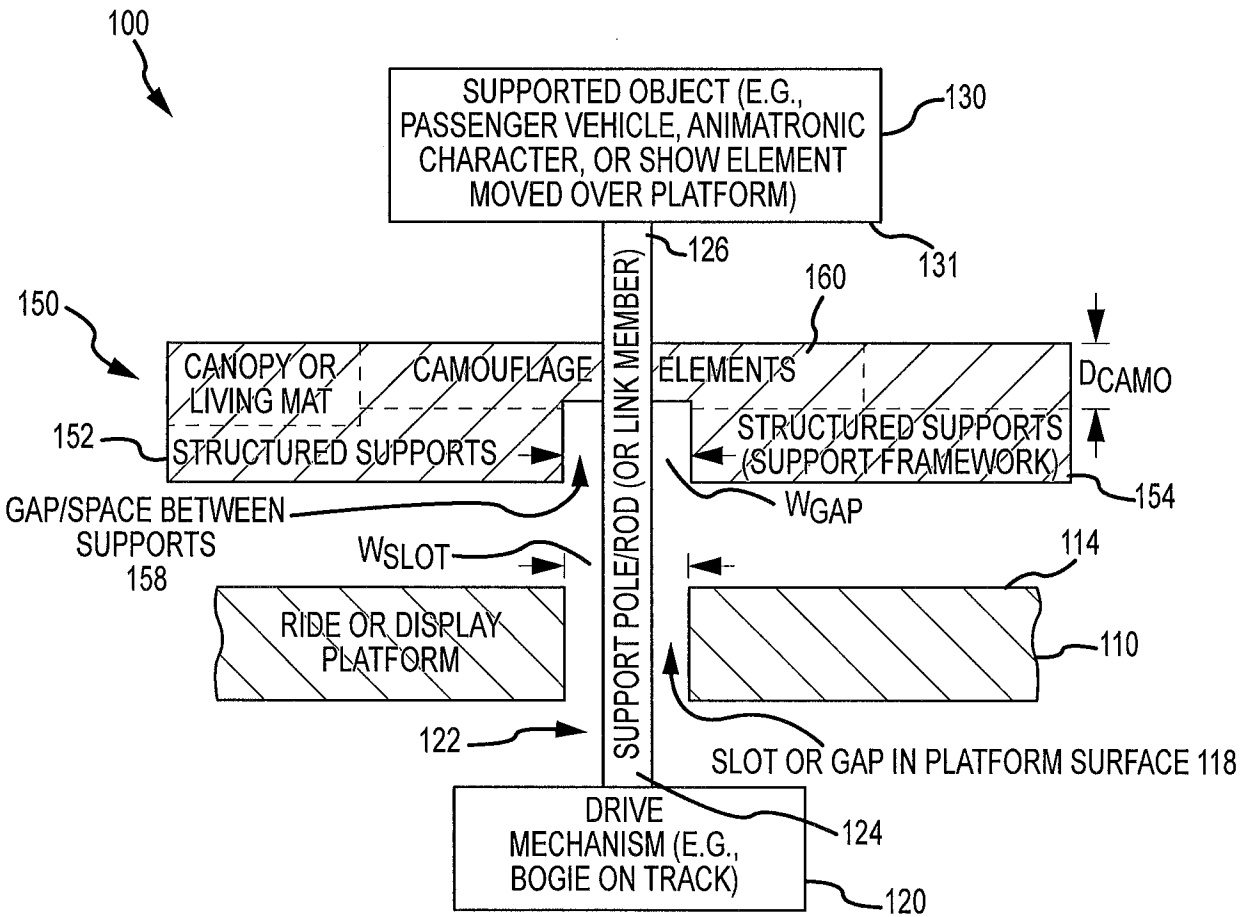
FIG. 1 is a functional block or schematic diagram (e.g., partial sectional side or end view) of an assembly for camouflaging or hiding from view support features, such as a slot in a platform, used in an amusement park ride or a display/show system.

FIG. 1 illustrates, with a functional block diagram or schematic (e.g., a partial sectional or end view), an assembly 100 that implements the slot-camouflaging aspects of the present description. The assembly 100 may be all or a portion of an amusement park ride or a show/display that moves an object/element 130, such as a passenger vehicle or a show element (e.g., a robot or animatronic character or the like) through a space and for which it is desirable to disguise how the object/element 130 is supported and moved through the space.

As shown, the assembly 100 includes a drive mechanism or assembly 120 such as a bogie or vehicle on a track, which defines a path for moving the object 130 through a space. The object 130 is supported by or linked to the drive mechanism 120 via a support pole/rod (or poles/rods) or link member 122. For example, an animatronic character may have one or two rigid poles/rods affixed to lower portions (e.g., its "feet" or other parts that touch or are near the surface 114) or a ride vehicle may be supported by a pole affixed to the center of the vehicle or two poles attached to front and rear portions of the vehicle. As shown, the support pole/rode 122 is attached at a first end 124 to the drive mechanism 120 and at a second end 126 to the object 130. In this way, movement of the drive mechanism 120 along a track or otherwise results in or is translated to a similar movement by the linked/supported object 130.

To hide the drive mechanism 120 from view and, in some cases, to add thematic features to the assembly 100, a ride or display platform 110 is positioned between the drive mechanism 120 and the supported object 130. The platform 110 may be a base or floor of a ride or a stage or it may be a vertical wall or even a ceiling (or suspended structure), with an exposed or object-side surface 114 proximate to the supported object 130. A slot or gap 118 is provided in the platform 110 that has a width, $W_{slot}$, that is large enough to allow the pole/rode 122 to extend through the platform 110 to the object 130 (e.g., $W_{slot}$ is greater than the outer dimensions (e.g., diameter) of the rod/pole 122). When the platform surface 114 is viewed from above or in a plan view (without the canopy 150), the slot or gap 118 defines a path or circuit along which the pole 122 and object 130 will travel or be guided by the drive mechanism 120.

To hide or at least camouflage the existence of the slot 118 and the pole 122, the assembly 100 includes a canopy or living mat 150. The canopy 150 is generally positioned between the surface 114 of the platform 110 and the surface 131 of the object 130 facing the platform 110. More specifically, the canopy or living mat 150 is provided adjacent to the slot or gap 118 in the platform 110 to block direct view of the slot 118. Exemplary configurations of the canopy or living mat 150 are described below, but, briefly, the canopy or living mat 150 is made up of a first set of structural supports (or a first support framework) 152 and a second set of structural supports (or a second support framework) 154. These supports 152, 154 are used to support and position a plurality of camouflage elements 160 over the slot/gap 118.

A gap or space 158 is provided between the two sets of structural supports 152, 154 such that the rod/pole 122 is free to travel through the canopy or living mat 150. However, in some embodiments, the camouflage elements 160 (or portions of such elements 160 or at least some of the elements 160) are positioned between the slot 118 in the platform 110 and the surface 131 of object 130 such that the pole/rod 122 has to be pushed/pulled or forced through the canopy 150 by the drive mechanism 120. The camouflage elements 160 are configured to allow this movement of the pole/rod 122 through the canopy 150 with a limited amount of resistance and without damage to (or with minimal wear on) the elements 160 (or pole/rod 122).

To this end, the camouflage elements 160 that extend into the space over the slot/gap 118 in the platform may include elements that rotate upon the structures 152, 154 when contacted by the pole/rod 122 and/or elements that are flexible/resilient to move out of the way and then bounce back to their original positions/forms. Often, a mixture or blend of flexible and rotatable elements are provided for elements 160 to add to the visual effect of the canopy 150 (e.g., to make it a "living" mat). In this way, the movement of the pole 122 through the camouflage elements 160 may be likened to movement of an object through grasses/plants or through seaweed or the like in water. The dimension of the pole/rode 122 or other structure that passes through the canopy 150 is not fixed and can vary due to the use of these flexible and/or rotating camouflage elements 160 while still hiding the slot 118 (e.g., poles 118 with two or more diameters, $Diam_{Pole}$, may be moved through the canopy 150).

To better hide the slot 118 from view, the camouflage elements 160 (at least over the gap/slot 118) may have a predefined depth, $D_{Camo}$, that is chosen such that even when some of the elements 160 (or their features, e.g., fingers, protrusions, tendrils, branches/leaves, and so on) are displaced it is difficult to see the slot (e.g., no or few direct lines of sight through the canopy 150 to the platform surface 114 and slot 118). In this regard, the depth, $D_{Camo}$, may be provided by overlapping layers/levels of the elements 160 or their features. These aspects of the canopy 150 will become readily apparent to those skilled in the art based the following discussion.

Figure 2:
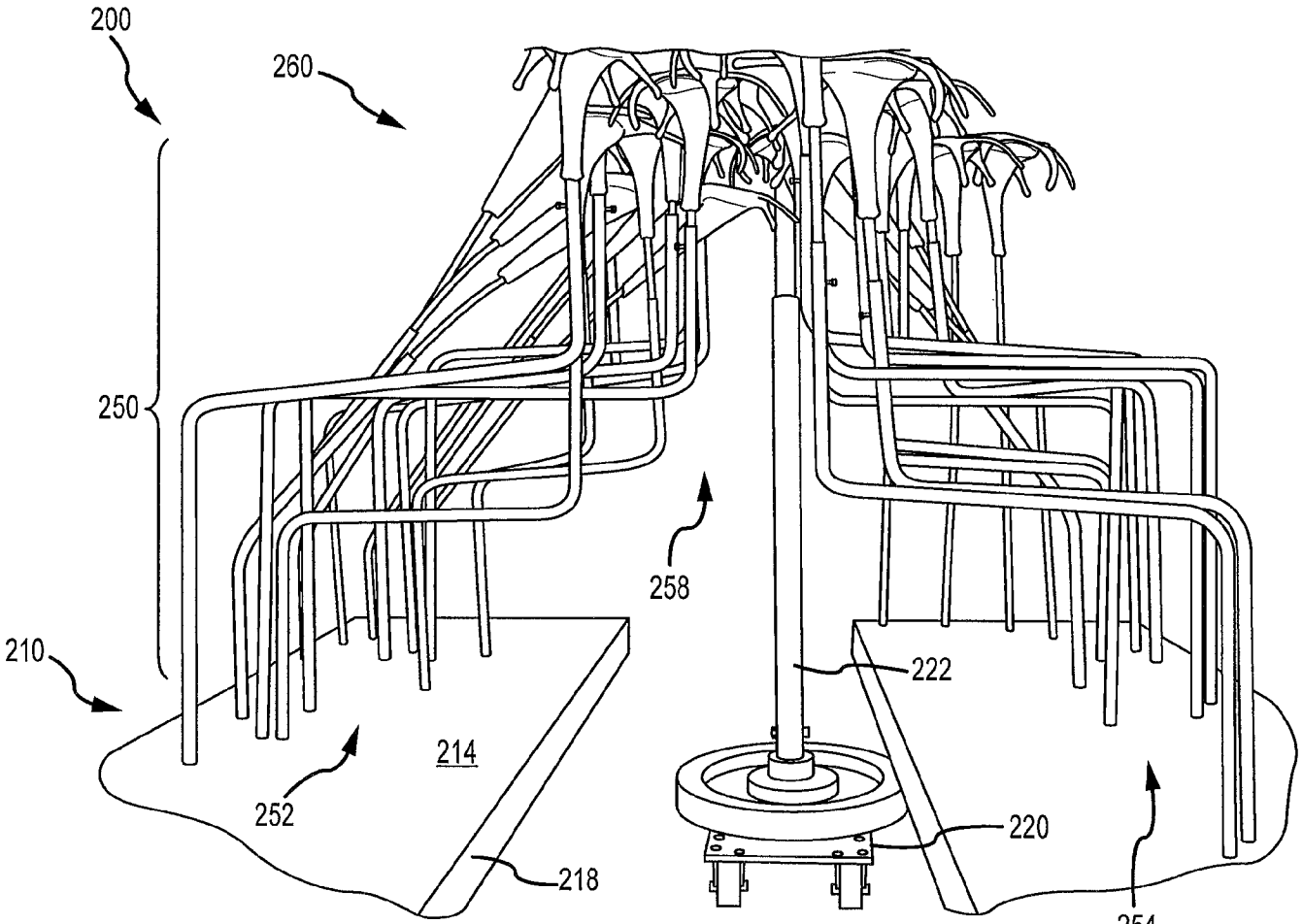
FIG. 2 is an end partial, perspective view of a portion of an assembly of the present description illustrating the use of a canopy or living mat to disguise or hide support features used to support and move an object (an animatronic figure (or other show/display element) or passenger vehicle, with an animatronic figure shown in FIG. 3)

FIG. 2 is an end perspective view (partial view) of a portion of an assembly 200 of the present description that may be a particular implementation of assembly 100 of FIG. 1. The assembly 200 is useful for illustrating the use of a canopy or living mat 250 to disguise or hide support features used to support and move an object (an animatronic figure (or other show/display element) or passenger vehicle, with an animatronic FIG. 230 shown in FIG. 3 being moved 231 through the canopy 250 by attached pole 222 and drive mechanism 220).

Particularly, with the behind (or below) the scenes view of FIG. 2, one can see a drive mechanism 220 that is used to move the supported object 230 via support pole/rod 222. A platform 210 is provided between the drive mechanism 220 and the object 230, with an upper or object-side surface 214 of the platform 210 facing the object 230. A slot or gap 218 is provided in the platform 210 such that the pole/rode 222 can extend between the drive mechanism 220 and the supported object 230 (shown in FIG. 3). As can be seen (or not seen) in FIG. 2, the object 230 is typically not visible through the canopy 250, which shows in a reciprocal manner that a viewer on the opposite side of the canopy 250 also would not be able to readily see the slot 218 or even most of the pole/rode 222.

As shown in FIG. 1, the canopy 250 of assembly 200 of FIG. 2 includes first and second sets of structural supports 252, 254 for a plurality of camouflage elements 260. A significant portion of the camouflage elements 260 are positioned adjacent to the slot 218 in the platform 210 to hide it from view and such that the support rod 222 (which in this example extends orthogonally from the surface 214 via slot 218) extends through and beyond these adjacently-positioned elements 260. The structural supports are shown to include positioning/supporting rods/shafts of various shapes and lengths as discussed below and with differing configurations to position the elements 260 adjacent (or, in this case, over) the slot 218 in the platform 210. The supports 252, 254 are also configured to place the camouflaging elements 260 in two, three, or more layers (or tiers) as can be seen in FIG. 2, which enables portions of the elements 260 to be pushed aside by the pole/rod 222 while others continue to block the line of sight to the slot 218 in the platform 210.

In combination, though, the structural supports 252, 254 define a gap or space 258 between the slot 218 and the camouflage elements 260 such that the pole/rod 222 may pass through the supports 252, 254 with little or, preferably, no contact with the supports 252, 254. The supporting rods/shafts may be straight and mounted to the surface 214 of the platform 210 at an angle (e.g., in the range of 30 to 60 degrees or the like) to desirably place an attached one of the camouflaging elements 260. Other supporting rods/shafts may be configured with a pair of bends as shown to extend vertically upward adjacent to the slot 218 to provide elements 260 directly over or adjacent (or nearly so) the slot 218 (e.g., the angle of support is 90 degrees while other elements are supported at an angle in the range of 30 to 60 degrees) while retaining a gap/space 258 between rods/shafts in the set of structural supports 252 and the set of structural supports 254. The length of the structural supports 252, 254 may vary widely to practice the assembly 200 but generally will be selected to place the camouflage elements 260 at a height above the surface 214 of the platform 210 that coincides with or is just below a point where the support rod/pole 222 attaches to the supported object 230. However, it is typically preferable that the camouflaging elements 260 be at least some predefined distance away from the surface 214 and slot 218 to better disguise their presence such as 1 to 3 feet or more.

Figure 3:
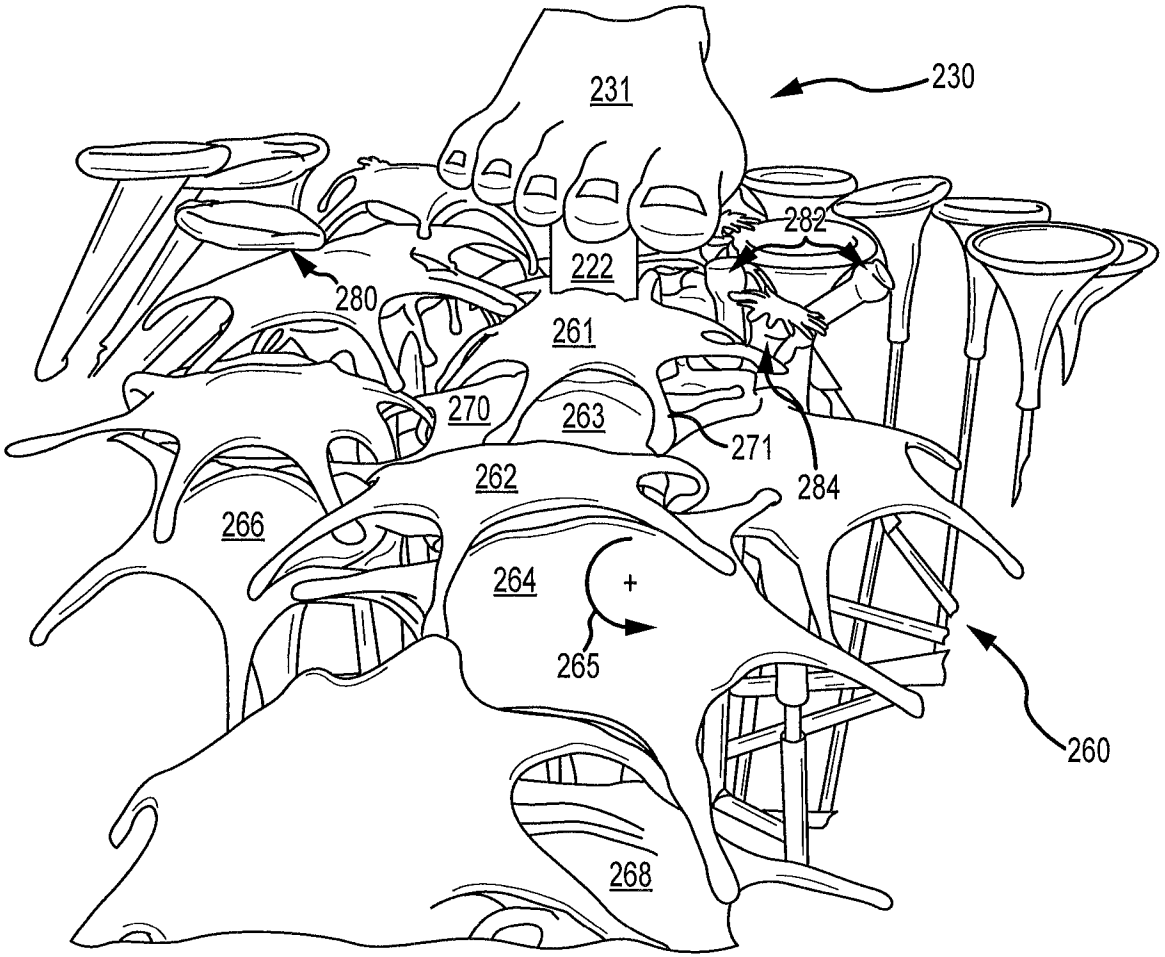
FIG. 3 is a top perspective view of the assembly of FIG. 2 showing the hiding of the slot in the platform and other support features (e.g., support pole is only partially visible and not visible from above) with numerous overlapping and layered/tiered camouflaging elements over (or adjacent to) the slot.

FIG. 3 is a top perspective view of the assembly 200 of FIG. 2. As shown from this view (similar to what observers of a display or ride may see), the canopy or living mat 250 with its camouflaging elements 260 is effectively hiding the slot 218 in the platform 210 and other support features (e.g., support pole 222) from view. For example, the slot 218 is not shown at all and the pole 222 is only partially visible and would not be visible at all from above the supported object 230. To this end, the canopy includes numerous overlapping and layered/tiered camouflaging elements over (or adjacent to) the slot 218. In other words, the canopy 250 is configured as a multi-tiered or multi-layered mat or screen over the underlying elements, but the canopy 250 includes camouflaging elements 260 that allow the pole/rod 222 to push or move through its layers/tiers.

In this example of a canopy 250, the elements 260 include a first type of camouflaging element 261, 262, 264, 266, 268, which are shown to have an organic or natural shape with a central body (e.g., a generally circular and planar or dome-shaped body) and extending tendrils or branches. As shown for element 261, the tendrils 270, 271 may be formed of a material and with a shape, thickness, and other parameters that allow them to be easily bent or flexed (e.g., formed of a relative soft rubber or plastic to provide a high degree of flex and/or resiliency), with tendril/protrusion 270 shown in its at-rest position and form and tendril/protrusion 271 being bent or curled due to contact with neighboring element 263.

The inventor has found it useful to provide irregular shaped camouflaging elements such as elements 261 with protrusions/tendrils 270, 271 as the mixing of irregular shapes and protrusions make the canopy 250 more dense and difficult to see through in contrast to simply planar sheets or the like. The camouflaging elements 260 often will include two to many differing designs with differing bodies and/or protruding components. For example, the elements 261, 262, 264, 266, 268 may all be of the same body and protrusion configuration/design (but could be of differing sizes and/or thicknesses with the same overall configuration), but other elements 280, 282, and 284 may be provided in the set of camouflaging elements 260 to provide additional cover for the slot 218 such as to fill gaps/spaces that may occur between adjacent elements if all are of the same shape and size. For example, the more tubular elements 282 may be provided to stick up through and between the protrusions or tendrils 270, 271 of the element 261. Likewise, some of the elements 260 (such as elements 261, 262, 264, 266, 268) may be formed to be very flexible and/or resilient while others of the elements 260 (such as elements 280) may be formed to be very rigid and/or solid.

As discussed above, the elements 260 are provided in two or more layers or tiers that are lain upon each other or spaced apart useful distances (such as 0.25 to 3 or more inches) These layers of the canopy elements 260 can be seen with camouflaging elements 261, 262, 264, 266, 268, which are provided in layers over the slot 218 of the platform 210. The elements 261 and 262 are shown to be in a first or outer layer ("outer" relative to the platform 210) and are closest to the bottom surface of the supported object 230 (so as to be at or some distance below this bottom surface or, in some cases, the layer of elements 261 and 262 may be above the bottom surface of the object 230 to further disguise the presence of the support features such as support rod/pole 222).

The elements 263, 264, 266 are shown to be in a second or intermediate layer, and, due to the use of support structures 252, 254, the elements 263, 264, 266 are typically at least partially offset from the elements 261, 262 of the first layer (e.g., the supporting rods/poles of the elements cannot occupy the same space causing at least some offsetting when the elements are viewed in a plan view or top view (in this example), with some of their bodies or tendrils overlapping the bodies or tendrils of adjacent or neighboring layers/tiers of the canopy 250. A third or inner layer ("inner" relative to the platform 210) is provided in the elements 260 as is shown with element 268 positioned adjacent to the element 264 but at a location closer to the platform 210 than the element 264. In this way, a line of sight past the elements 262 and 264 of the outer and intermediate layers may still be blocked by the element 268 in the inner layer of the canopy 250.

Some of the elements may be mounted for no rotation or rigidly affixed to the end of a support structure such as element 262 while other elements may be mounted/supported for full or partial rotation about the end of a support structure. For example, element 264 is shown to be rotatable about its central axis (which coincides in this example with a mounting point to a support structure) such as when the pole/rod 222 supporting the object 230 contacts its tendrils/branches or when contacted by a neighboring camouflaging element.

Figure 4:
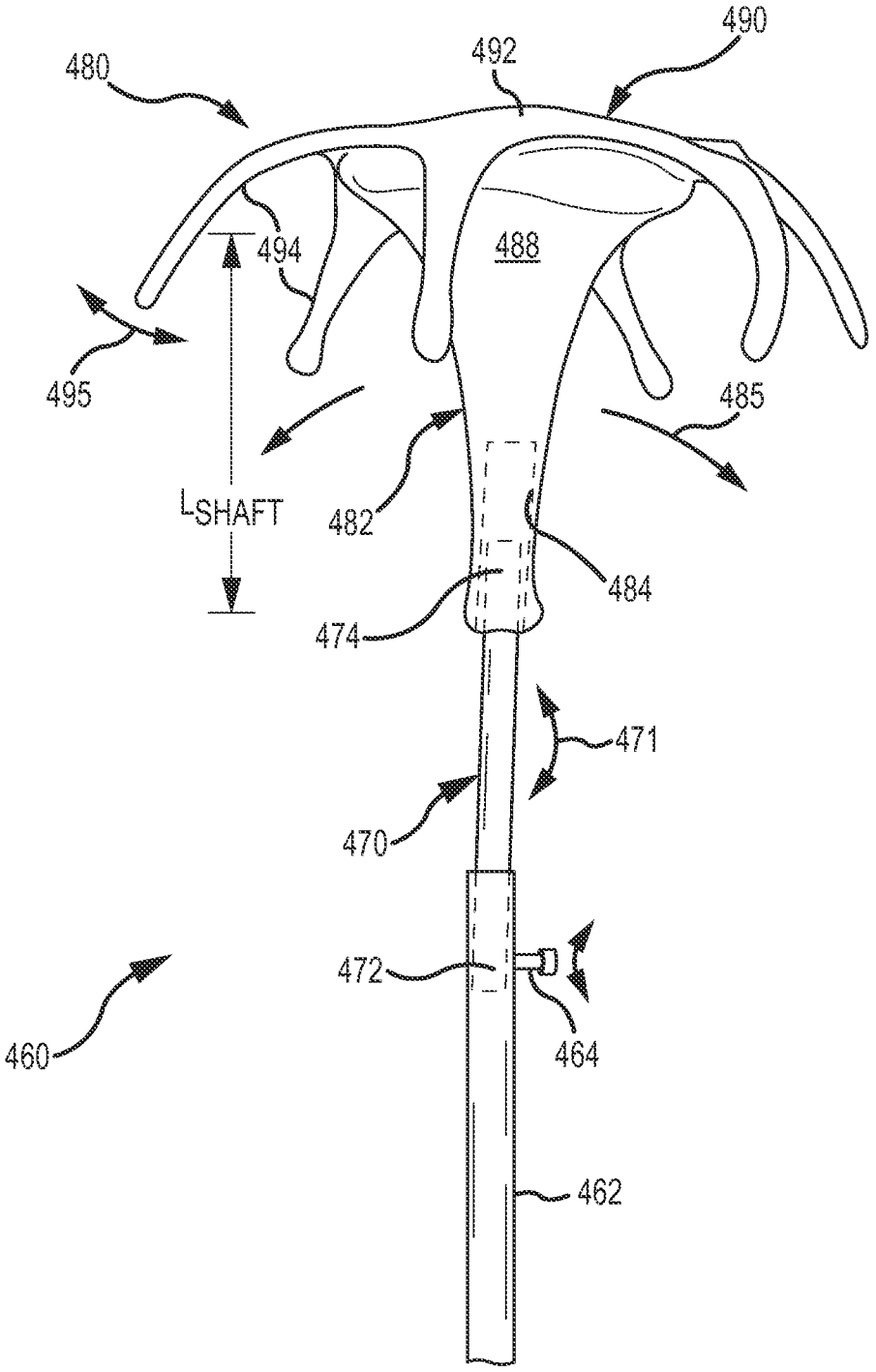
FIG. 4 is a side view of a camouflaging element assembly of one embodiment.

FIG. 4 illustrates a side view of one exemplary camouflaging element assembly 460 that may be used to provide a canopy or live mat as discussed herein. As shown, a structural support 462 is provided in the form of a rigid tube (e.g., a metal tube), and a connecting rod (e.g., a solid or tubular rod) 470 is inserted into an open end of the support 462 (end 472 of rod 470 is placed inside the tube/support 462). A locking mechanism 464 (such as a screw or the like) is provided to lock (with rotation) the connecting rod 470 in place in the support 462. The locking may be firm/tight to prevent the connecting rod 470 and camouflaging element 480 from rotating about the axis of support 422 or be loose (or no contact at all) to allow the connecting rod 470 and element 480 to rotate when placed in a canopy.

The connecting rod 470 may be fabricated of a material such as rubber or plastic such that it is relatively stiff to support the camouflaging element 480, but it is often desirable for the rod 470 to be flexible to allow the rod 470 to bend as shown with arrow 471 (and, optionally, bounce back). In this way, the element 480 may be moved as a whole relative to the support 462 when a force is applied to it when in use in a canopy or living mat. The camouflaging element 480 is shown to include a shaft 482 with a socket or receptacle 484 for receiving and mating with the end 474 of the connecting rod 470 (e.g., mating may be of a lock type with a ridge provided on the end 474 and a recessed ring/surface(s) provided in the receptacle/socket 484 of the shaft 482 or the mating may be of a press-fit type).

The flexibility (as shown with arrows 485) of the camouflaging element 480 may be set or controlled in part by selecting a material for the shaft 482 (e.g., hardness of a rubber or plastic used in molding the shaft 482 can be used to set the degree of flex). The flexibility 485 may also be controlled by selection of physical parameters such as length, $L_{Shaft}$, of the shaft 482 and also its diameter. Further, flex or movement 485 may be controlled by the length of or amount of the end 474 of the connecting rod 470 inserted into the receptacle 484, which will allow the flex to be set upon fabrication of the assembly 460 (or in the field in some cases during installation to achieve a desired amount of movement among a plurality of elements 480 in a canopy), with the shaft 482 having more flex 485 when a smaller amount of the end 474 is inserted. Also, the use of the support 462 and the connecting rod 470 allows the assembly 460 to readily be modified such as by removal of the element 480 and application of another camouflaging element with the same or, more often, a different design, which may be useful to replace damaged elements or to change the look and/or action of a particular canopy. For example, the receptacle 484 may have a length 1 to 4 inches, and the movement 485 may be reduced by placing the end 474 fully into the receptacle 484 versus only providing a fraction of the mating length of connecting rod 470.

The line of sight through a canopy is controlled in large part by the camouflaging elements upper body 490, which is affixed to the shaft 482 via base 488. In other cases, though, the entire element 480 may be molded or otherwise formed to be an integral or one-piece body or the shaft 482 and base 488 may be formed as one piece and the upper body 490 attached/bonded to the base 488 in a later fabrication step, which would allow the shaft 482 and base 488 to be used as a camouflaging element by themselves or with another upper body of differing design.

The upper body 490 has a center portion 492 (e.g., a circular planar member) covering the base 488, and, from this portion 492, the upper body 490 includes a plurality of arms, protrusions, branches, or other features 494 that extend outward from the outer perimeter of the center portion 492. These arms 494 may be spaced apart as shown to allow features of other camouflaging elements to be placed between the arms 494. The arms 494 may be relatively stiff or rigid or may have a degree of flex as shown with arrow 495, and the amount of flex 495 may be varied to implement the element 480 and controlled by selecting the material and its hardness used to form the arms 494, by increasing or decreasing the diameter or outer dimensions of the arms 494, by increasing or decreasing the length of the arms 494 (or amount they extend out from the edges of the center portion 492), and/or by choosing other design criteria. In many applications, it is useful for the arms/tendrils 494 to be very flexible and resilient to allow a rod/pole supporting an object to easily pass through a canopy by moving the arms out of the way and because the movement 495 (moving with the pole/rod and then bouncing back into an at-rest position/shape) attracts the attention of a viewer (i.e., away from a light of sight through the canopy to a slot in a platform or to a support pole/rod for the object).

Figure 5:
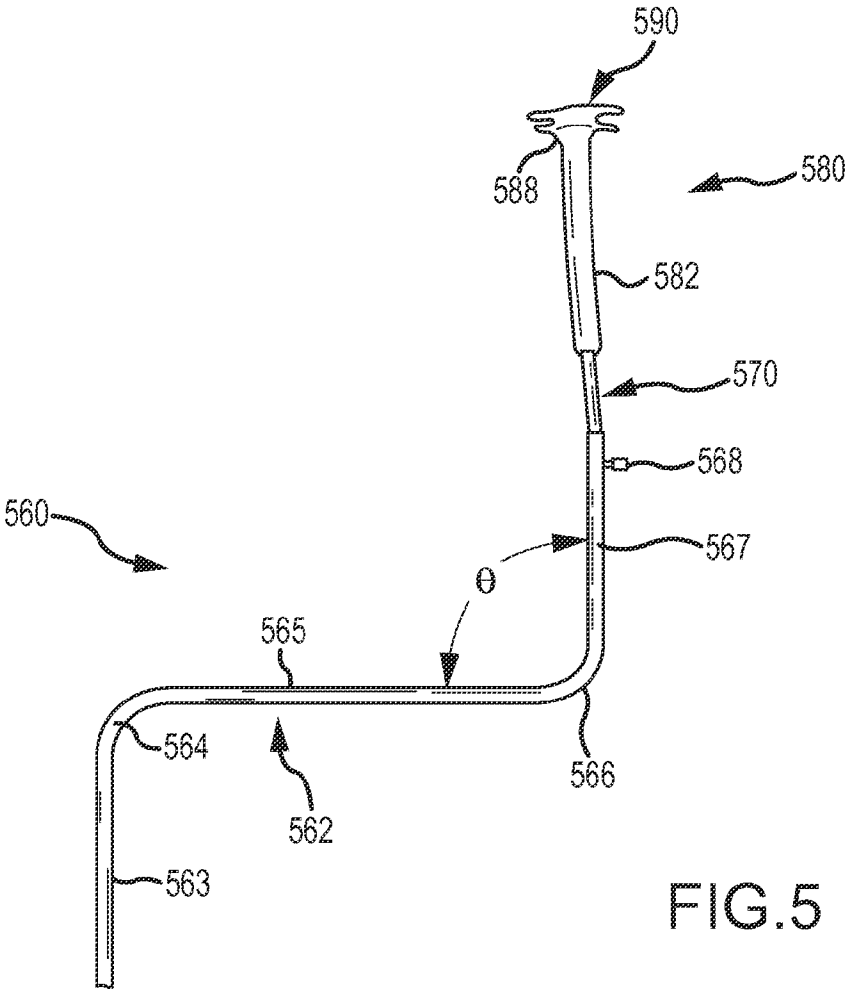
FIG. 5 is a side view of another camouflaging element assembly of the present description.

FIG. 5 illustrates another embodiment of a camouflaging element assembly 560 that may be used to fabricate or assemble a canopy of the present description (e.g., with assembly 460). The assembly 560 includes a structural support 562 that may be attached to an upper surface of a platform near a slot/gap in the platform. The support 562 includes a first/lower run 563 of tubing, which may extend upward (vertically or horizontally) from a platform surface to a bend 564 (e.g., a 45 to 90 degree bend or the like). A second/middle run 565 of tubing then extends (horizontally or vertically) from the first bend 564 to a second bend 566, and a third/upper run 567 of the tubing is provided that extends (vertically or horizontally) away from the second bend 566 to define a connection location or position for the connecting rod 570.

The use of two bends 564 and 566 combined with intermediate run 565 allows the support 562 to be attached at a first location and then position the final run 567 of the support 562 adjacent an edge of (the run 565 helps define the space/gap between sets of structural supports in an installed canopy), or even over, the slot/gap in the platform. The final bend 566 may be at an angle, θ, that is desirable for finally positioning a camouflaging element 580 over or adjacent the slot in the platform (or among other camouflaging elements), and this may be about 60 to 145 degrees (with about 90 degrees being shown in FIG. 5). The lengths of the runs 563 and 567 are used, typically, to help set the location of the camouflaging elements 580 relative to the platform surface and its slot/gap, when considered along with the exposed length of connecting rod 570 and the length of shaft 582.

The assembly 560 also includes a connecting rod 570 that is attached to the end of run 567 of structural support 562, and a locking mechanism 568 may be adjusted to hold the rod 570 in position (for no or little rotation about its axis) or to allow rotation. The other end of the connecting rod 570 is attached to the camouflaging element 580 (e.g., an end is inserted into a hollow end of the shaft 582 of the element 580). The camouflaging element 580 differs from camouflaging element 480 in that the shaft 582 is more cylindrical than the shaft 482, which is more conical (diameter increases from one end to the other). This makes the shaft 582 more flexible/bendable assuming the same material is used for both shafts 482, 582 and that the same amount of rod 570 is inserted to provide support within the assembly 560 for the camouflaging element 580.

The camouflaging element 580 includes a base 588 attached to the opposite end of the shaft 582, and an upper body 590 is affixed to the base 588. The upper body 590 differs from upper body 490 in that it has a central portion that is much smaller in diameter (e.g., matches or is only somewhat larger than base 588) and in that it includes more arms/tendrils that are smaller (in length, diameter, and spacing). As discussed above, it is often desirable for a canopy to be fabricated with a variety of camouflaging element designs such that the mat/canopy can be more densely filled in to block view and to take on a more organic or natural appearance (e.g., nature typically is not uniform in appearance as plants in an undergrowth vary widely in appearance and movement (rigidity and so on)). For example, the smaller and differing shape of the shaft 582 and upper body 590 may allow the element 580 to be used alongside the element 480, with the element 580 extending between and above/below the arms/tendrils of the element 480.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. Through the overlapping nature/arrangement of the canopy components (e.g., camouflaging elements) and the myriad combinations that can be achieved, the assemblies described herein provide a very organic solution to a problem that previously had only been broached in purely engineering terms. The use of a canopy or living mat may encompass both hard and soft camouflaging elements that can be used to cater to the aesthetics of a show or ride environment that is fully visible.

A tested prototype of a canopy was used to disguise movement of a support pole/rod for a leg of an animatronic figure.

The camouflaging elements showed good resilience to having the support pole/rod pushed through them and their overlapping bodies and/or arm/protrusions/extensions many times. The camouflaging elements may be provided as molded and/or cast parts. This allows a vast array of pigmentation to be used, and the elements may be many colors, be luminescent, glow in the dark, and be UV active (or have UV active tints). Further, a vehicle-triggered UV device may be provided in the assembly such that the camouflaging elements could have UV light selectively directed upon them to provide a bioluminescent effect when a vehicle/show element bumps into them or moves through them (e.g., allow the passengers of a vehicle or a trailing vehicle to visually enjoy the ride experience and moving through the canopy or live mat).

I claim:

1. An assembly adapted for visually disguising drive or support features, comprising:

a platform;

a drive mechanism for selectively moving a support member;

an object supported upon an end of the support member spaced apart from the drive mechanism, the support member extending through a slot in the platform; and a canopy positioned between the supported object and a surface of the platform facing the supported object, wherein the canopy comprises a plurality of camouflaging elements positioned between the slot in the platform and the supported object.

2. The assembly of claim 1, wherein the camouflaging elements are arranged in two or more layers adjacent to the slot.

3. The assembly of claim 2, wherein at least a portion of the camouflaging elements in adjacent pairs of the layers at least partially overlap when viewed from the supported object and wherein the support member contacts and moves a number of the camouflaging elements when the drive mechanism operates to move the support member through the canopy.

4. The assembly of claim 1, wherein a subset of the camouflaging elements are rotatably mounted on structural supports, whereby each one of the subset of the camouflaging elements independently rotates in response to being contacted by the support member or the supported object.

5. The assembly of claim 1, wherein a number of the camouflaging elements include a flexible and resilient shaft supporting an upper body.

6. The assembly of claim 5, wherein the number of the camouflaging elements further include a plurality of flexible and resilient arms or protruding members extending outward from a central portion of the upper body.

7. The assembly of claim 5, wherein each of the shafts is attached to a structural member via a connecting rod and wherein an end of the connecting rod is inserted a depth within a receptacle in an end of the shaft, whereby flexibility of the shaft is controlled by the depth.

8. The assembly of claim 1, wherein a first set of the camouflaging elements is supported by a first set of structural supports attached to the surface of the platform on a first side of the slot in the platform, wherein a second set of the camouflaging elements is supported by a second sets of structural supports attached to the surface of the platform on a second side of the slot in the platform, and wherein a gap is provided between the first and second sets of the structural supports between the slot and the object, whereby the support member is movable through the canopy free of contact with the structural supports.

9. An assembly comprising:

a platform;

a drive mechanism for selectively moving a support member that extends through a slot in the platform;

an object supported by the support member; and a canopy positioned between the supported object and a surface of the platform facing the supported object, wherein the canopy comprises a plurality of camouflaging elements positioned between the slot in the platform and the supported object, wherein the camouflaging elements are arranged in two or more layers adjacent to the slot, wherein at least a portion of the camouflaging elements in adjacent pairs of the layers at least partially overlap when viewed from the supported object, and wherein the support member contacts and moves a number of the camouflaging elements when the drive mechanism operates to move the support member through the canopy.

10. The assembly of claim 9, wherein a subset of the camouflaging elements are rotatably mounted on structural supports, whereby each one of the subset of the camouflaging elements independently rotates in response to being contacted by the support member or the supported object.

11. The assembly of claim 9, wherein a number of the camouflaging elements include a flexible and resilient shaft supporting an upper body.

12. The assembly of claim 11, wherein the number of the camouflaging elements further include a plurality of flexible and resilient arms or protruding members extending outward from a central portion of the upper body.

13. The assembly of claim 11, wherein each of the shafts is attached to a structural member via a connecting rod and wherein an end of the connecting rod is inserted a depth within a receptacle in an end of the shaft, whereby flexibility of the shaft is controlled by the depth.

14. The assembly of claim 9, wherein a first set of the camouflaging elements is supported by a first set of structural supports attached to the surface of the platform on a first side of the slot in the platform, wherein a second set of the camouflaging elements is supported by a second set of structural supports attached to the surface of the platform on a second side of the slot in the platform, and wherein a gap is provided between the first and second sets of the structural supports between the slot and the object, whereby the support member is movable through the canopy free of contact with the structural supports.

15. An assembly, comprising:

a drive mechanism for selectively moving a support member;

an object supported upon an end of the support member spaced apart from the drive mechanism; and a canopy positioned between the supported object and the drive mechanism, wherein the canopy comprises a plurality of camouflaging elements, wherein the camouflaging elements are arranged in two or more layers adjacent to the slot, wherein a number of the camouflaging elements include a flexible and resilient shaft supporting an upper body, and wherein the number of the camouflaging elements further include a plurality of flexible and resilient arms or protruding members extending outward from a central portion of the upper body.

16. The assembly of claim 15, wherein each of the shafts is attached to a structural member via a connecting rod and wherein an end of the connecting rod is inserted a depth within a receptacle in an end of the shaft, whereby flexibility of the shaft is controlled by the depth.

17. The assembly of claim 15, wherein at least a portion of the camouflaging elements in adjacent pairs of the layers at least partially overlap when viewed from the supported object.

18. The assembly of claim 15, wherein the support member contacts and moves a number of the camouflaging elements when the drive mechanism operates to move the support member through the canopy.

19. The assembly of claim 15, wherein a subset of the camouflaging elements are rotatably mounted on structural supports, whereby each one the subset of the camouflaging elements independently rotates in response to being contacted by the support member or the supported object.

20. The assembly of claim 15, wherein a first set of the camouflaging elements is supported by a first set of structural supports attached to the surface of the platform on a first side of the slot in the platform, wherein a second set of the camouflaging elements is supported by a second set of structural supports attached to the surface of the platform on a second side of the slot in the platform, and wherein a gap is provided between the first and second sets of the structural supports between the slot and the object, whereby the support member is movable through the canopy free of contact with the structural supports.

* * * * *